US005299637A

United States Patent [19]

Skönvall

[11] Patent Number: 5,299,637

[45] Date of Patent: Apr. 5, 1994

[54] CONCRETE WELL

[76] Inventor: Tage Skönvall, Ekudden, S-520 15 Hökerum, Sweden

[21] Appl. No.: 935,491

[22] Filed: Aug. 25, 1992

[51] Int. Cl.[5] ..... E21B 33/03; E21B 43/00

[52] U.S. Cl. ..... 166/75.1; 52/21

[58] Field of Search ..... 166/75.1, 92, 93, 94, 166/67; 52/20, 21; 404/25, 26

[56] References Cited

U.S. PATENT DOCUMENTS

| | | | |
|---|---|---|---|
| 3,250,190 | 5/1966 | Taylor | 404/25 |
| 3,263,579 | 8/1966 | Dorris | 404/26 |
| 3,926,533 | 2/1970 | Binette | 404/26 |
| 3,938,285 | 2/1976 | Gilbu | 52/20 |
| 4,187,647 | 12/1975 | Hall | 29/14 |
| 4,255,909 | 3/1981 | Soderstrom | 404/26 X |
| 4,350,177 | 9/1982 | Firchau et al. | 404/26 X |
| 4,842,060 | 6/1989 | Paulus | 166/75.1 |
| 4,957,389 | 9/1990 | Neathery | 404/25 X |

FOREIGN PATENT DOCUMENTS 0147050 7/1985 European Pat. Off. ..... 29/14

*Primary Examiner*—Stephen J. Novosad

*Attorney, Agent, or Firm*—Joseph C. Mason, Jr.; Ronald E. Smith

[57] ABSTRACT

A concrete well having an upper axial portion (10) decreasing in width axially from a larger bottom cross section to a smaller cross section at an upper opening of the well. The well includes an annular raiser (12) which is injection-molded of a plastic material and is located on the upper end surface (11) of the well surrounding said opening to extend the well axially upwards. The raiser has depressions (19) which extend in the peripheral direction of the raiser alternatingly on one side and the other of the raiser. The depressions are arranged in groups regularly spaced from each other by transverse solid portions (21) of the raiser. A well covering (13, 14) is supported on the raiser.

12 Claims, 2 Drawing Sheets

CONCRETE WELL

Figure 1:
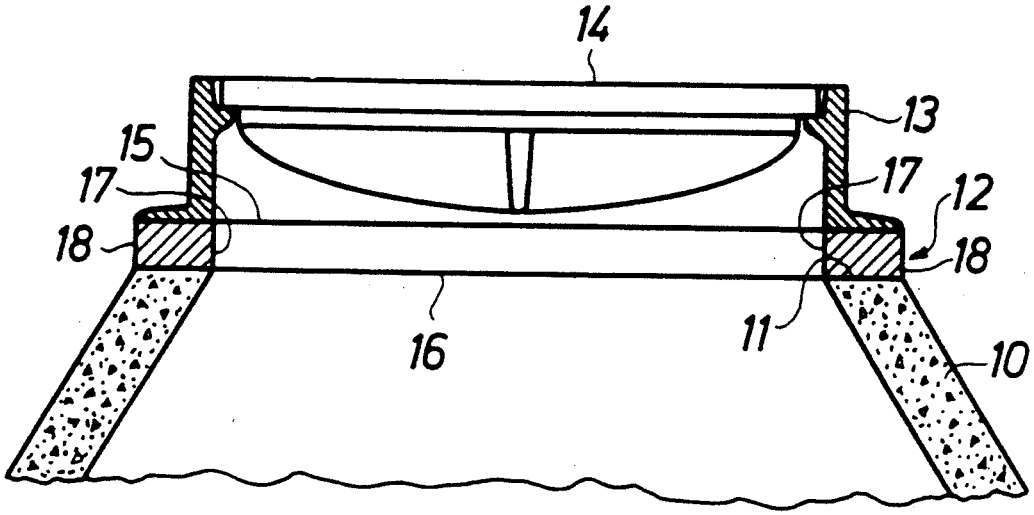

This invention relates to a concrete well such as a surface water well or an access well, having an upper portion decreasing in width axially from a larger bottom cross section to a smaller cross section at an upper opening of the well, said well comprising an annular raiser extending the well upwards, which is located on the upper end surface of the well, surrounding said opening, and a well covering supported by said raiser.

It is common practice and has been so for several years to make also the raiser of concrete as a concrete ring although obvious drawbacks are inherently connected with such a concrete ring. Since the molded concrete ring always has very rough surfaces including the annular end surfaces thereof, it is difficult to obtain a tight connection between the ring and the well so that fine grain material from the surrounding ground will leak into the well between the upper end surface thereof and the abutting lower end surface of the concrete ring if there is not provided some kind of tight joint therebetween. Moreover, the concrete ring does not provide a planar and even supporting surface for the well covering when it is located directly on the upper annular surface of the concrete ring as it usually is. As a consequence thereof the well covering will rock on the concrete ring when vehicles are passing over the covering, which means that the concrete ring eventually will crack. Finally, the concrete ring is heavy and the mounting thereof is cumbersome.

The object of the invention is to provide a raiser which eliminates the drawbacks of the concrete ring raiser accounted for above, and in order to achieve this object the novel structure is injection molded and includes a raiser for supporting a cover for a well, said raiser including an annular main body having a predetermined thickness, a top surface of predetermined radial extent, and a bottom surface of equal radial extent, a plurality of radially disposed spoke members formed in said main body, each of said spoke members having a thickness equal to said predetermined thickness and a predetermined radial extent equal to the common radial extent of said top and bottom surfaces, a plurality of circumferentially extending, radially spaced apart, depressions formed in said main body between each of said spoke members, each of said depressions extending downwardly from said top surface toward said bottom surface, said downwardly extending depressions collectively forming a plurality of concentrically disposed, radially spaced apart downwardly extending depressions, each of which is bounded at its opposite ends by said spoke members, a plurality of circumferentially extending, radially spaced apart, projections formed in said main body between each spoke member of said plurality of spoke members, each of said projections extending upwardly from said bottom surface toward said top surface, said upwardly extending projections collectively forming a plurality of concentrically disposed, radially spaced apart, upwardly extending projections, each of which is bounded at its opposite ends by said spoke members, said downwardly and upwardly extending depressions and projections being disposed in radially spaced apart, alternating relation to one another so that a downwardly extending projection as viewed from the top surface of said raiser forms an upwardly extending projection as viewed from the bottom surface of the raiser and so that a downwardly extending projection as viewed from the bottom surface of said raiser forms a downwardly extending depression as viewed from the top surface of the raiser, whereby said alternating downwardly and upwardly extending depressions and projections and said spoke members collectively provide a light in weight but strong raiser.

In the preferred embodiment of the invention the raiser is made of PELD and preferably of fiber reinforced PELD to increase the strength of the raiser.

It is also preferred that the depressions of the raiser contain a filler which may comprise sand, mortar or plaster and is filled into the depressions at the site where the raiser is to be mounted. However, the preferred filler comprises a rigid or substantially rigid plastic foam such as polyurethane foam, such filler stiffening up the raiser so that it can stand a higher load from vehicles passing over the well cover. The polyurethane foam adheres to the walls of the depressions and can be applied to the raiser at the site of manufacture so that the raiser can be delivered with filler in the depressions ready for use.

Figure 2:
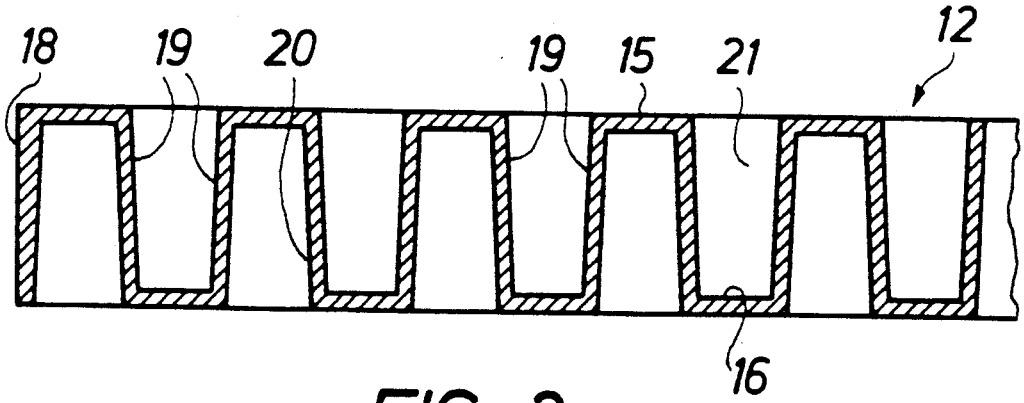
Figure 3:
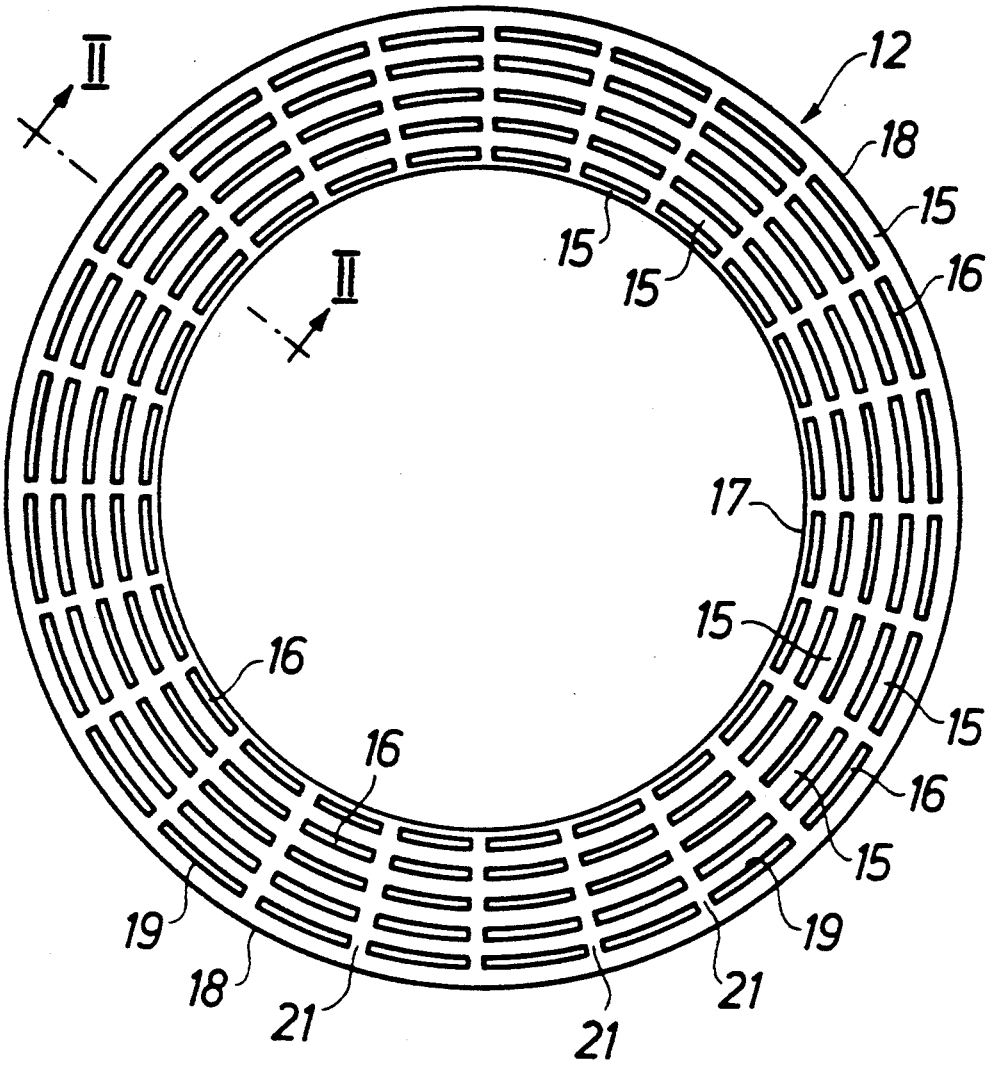

In order to explain the invention in more detail an embodiment thereof will be described below, reference being made to the accompanying drawings in which FIG. 1 is a fragmentary vertical cross sectional view of the upper portion of a well provided with the raiser according to the invention, FIG. 2 is an enlarged cross sectional view taken along line II—II in FIG. 3, and FIG. 3 is a plan view of the raiser.

The well, which may be a surface water well or an access well or any other type of well made of concrete has a wider lower portion (not shown in the drawings) and an upper portion 10, FIG. 1, which decreases in width over the axial length thereof to form at the top of the well an annular circular planar end surface 11. On top of the well portion 10 a raiser 12 forming a circular ring is supported on the annular surface 11 to extend the well axially upwards. Two or more raisers may be provided, one on top of the other. The raiser or the uppermost raiser, respectively, supports a circular covering ring 13 with a cover 14, the covering ring and the cover conventionally being made of cast iron.

The raiser 12, disclosed in more detail in FIGS. 2 and 3, forms upper and lower circular end surfaces 15 and 16 and inner and outer cylindrical surfaces 17 and 18. It is injection-molded of PELD (polyethylene of low density ranging from 0.949 to 0.965) and preferably is coloured by means of a black pigment in order to have improved ability of withstanding the influence of ultraviolet radiation when stored outdoors. The raiser has a number of circularly extending depressions 19 in the top thereof, which are provided alternatingly with corresponding depressions 20 in the bottom, as seen in the direction from the center of the raiser towards the periphery thereof. The depressions are arranged in groups by being separated regularly by radial solid portions 21 extending over the entire thickness of the raiser and forming spokes therein. Moreover, the depressions are defined by side and bottom wall portions of unitary thickness which are shaped with relief by the side wall surfaces including an angle of about 5 degrees with the perpendicular of the bottom surface.

The raiser being injection-molded combines a low consumption of material with improved ability of standing pressure imparted to it by vehicles passing over the well covering, but this ability can be further improved by filling the depressions 19 on one side of the raiser with sand or by filling these depressions as well as the depressions 20 on the lower side with mortar or plaster. This can be done at the site where the raiser is to be mounted. However, in the preferred embodiment the depressions 19 and 20 are filled with rigid or substantially rigid plastic foam 22 as has been indicated to the left in FIG. 2, and it has been found advantageous to use for this purpose polyurethane foam that adheres to the walls of the depressions. In this latter case the raiser can be delivered from the site of manufacture with the filler in the depressions, ready for use.

The raiser described is circular but other configurations are possible, for instance rectangular or square. Moreover, the end surfaces of the raiser need not be parallel; they may include a small angle.

I claim:

1. A raiser for supporting a cover for a well, comprising:

an annular main body having a predetermined thickness, a top surface of predetermined radial extent, and a bottom surface of equal radial extent;

a plurality of radially disposed spoke members formed in said main body, each of said spoke members having a thickness equal to said predetermined thickness and a predetermined radial extent equal to the common radial extent of said top and bottom surfaces;

a plurality of circumferentially extending, radially spaced apart depressions formed in said main body between each of said spoke members, each of said depressions extending downwardly from said top surface toward said bottom surface, said downwardly extending depressions collectively forming a plurality of concentrically disposed, radially spaced apart, downwardly extending depressions, each of which is bounded at its opposite ends by said spoke members;

a plurality of circumferentially extending, radially spaced apart projections formed in said main body between each spoke member of said plurality of spoke members, each of said projections extending upwardly, from said bottom surface toward said top surface, said upwardly extending projections collectively forming a plurality of concentrically disposed, radially spaced apart, upwardly extending projections, each of which is bounded at its opposite ends by said spoke members;

said downwardly and upwardly extending depressions and projections being disposed in radially spaced apart, alternating relation to one another so that a downwardly extending depression, as viewed from the top surface of said raiser, forms an upwardly extending projection as viewed from the bottom surface of the raiser and so that a downwardly extending depression, as viewed from the bottom surface of said raiser, forms an upwardly extending projection as viewed from the top surface of the raiser;

whereby said alternating downwardly and upwardly extending depressions and projections and said spoke members collectively provide a light in weight but strong raiser.

2. The raiser of claim 1, wherein said main body is injection-molded of a plastic material.

3. The raiser of claim 2, wherein said plastic material is low density polyethylene.

4. The raiser of claim 2, wherein said plastic material is fiber reinforced.

5. The raiser of claim 1, further comprising a filler disposed in at least one of said downwardly extending depressions.

6. The raiser of claim 1, further comprising a filler disposed in at least one of said upwardly extending projections.

7. The raiser of claim 6, wherein said filler includes sand.

8. The raiser of claim 6, wherein said filler includes mortar.

9. The raiser of claim 6, wherein said filler includes plaster.

10. The raiser of claim 9, wherein said filler includes polyurethane.

11. The raiser of claim 6, wherein said filler includes a plastic foam.

12. The raiser of claim 11, wherein said filler includes a substantially rigid plastic foam.

* * * * *